US008492681B2

(12) United States Patent
Satanek

(10) Patent No.: US 8,492,681 B2
(45) Date of Patent: Jul. 23, 2013

(54) OVEN CONTROL SYSTEM WITH OPERATING STAGE INDICATION

(75) Inventor: Brandon L. Satanek, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 774 days.

(21) Appl. No.: 12/582,311

(22) Filed: Oct. 20, 2009

(65) Prior Publication Data

US 2011/0089158 A1 Apr. 21, 2011

(51) Int. Cl.
*H05B 1/02* (2006.01)

(52) U.S. Cl.
USPC ..... 219/506

(58) Field of Classification Search
USPC ..... 219/506
See application file for complete search history.

(56) References Cited

U.S. PATENT DOCUMENTS

| | | | | |
|---|---|---|---|---|
| 4,447,692 | A | 5/1984 | Mierzwinski | |
| 4,628,351 | A | 12/1986 | Heo | |
| 4,695,711 | A | 9/1987 | McGeorge | |
| 4,914,277 | A * | 4/1990 | Guerin et al. | 219/506 |
| 5,382,939 | A | 1/1995 | Hong | |
| 5,877,477 | A * | 3/1999 | Petty et al. | 219/506 |
| 6,064,050 | A * | 5/2000 | Ishikawa et al. | 219/720 |
| 6,255,630 | B1 | 7/2001 | Barnes et al. | |
| 7,247,821 | B2 * | 7/2007 | Wilsdorf | 219/506 |
| 7,378,620 | B2 * | 5/2008 | Lubrina | 219/505 |
| 2006/0043087 | A1 * | 3/2006 | Gagas et al. | 219/391 |
| 2007/0045433 | A1 * | 3/2007 | Chapman et al. | 236/46 R |
| 2008/0082217 | A1 | 4/2008 | Sung et al. | |
| 2008/0236563 | A1 | 10/2008 | Wilsdorf | |
| 2011/0265706 | A1 * | 11/2011 | Nicholls | 116/201 |

FOREIGN PATENT DOCUMENTS

| | | | |
|---|---|---|---|
| JP | 62220158 | A | 9/1987 |
| JP | 1200591 | A | 8/1989 |
| JP | 7269875 | A | 10/1995 |
| JP | 2002228159 | A | 8/2002 |
| JP | 2002290955 | A | 10/2002 |
| JP | 2005352412 | A * | 12/2005 |

* cited by examiner

*Primary Examiner* — Hoai V Ho
*Assistant Examiner* — Min Huang

(57) ABSTRACT

A cooking appliance includes a cabinet defining an oven cavity, a door attached to the cabinet for selectively exposing and sealing the oven cavity, a cooking element mounted to the cabinet for heating the oven cavity, a control system for controlling the cooking appliance and a display. The display is adapted to show a first series of images corresponding to a first operating stage and a second series of images corresponding to a second operating stage, wherein the first series of images is distinct from the second series of images such that a user may readily identify a current operating stage of the cooking appliance, even from a distance, based on the series of images being displayed.

18 Claims, 3 Drawing Sheets

OVEN CONTROL SYSTEM WITH OPERATING STAGE INDICATION

BACKGROUND OF THE INVENTION

1. Field of the Invention

The present invention pertains to the art of cooking appliances and, more particularly, to a cooking appliance including a display for indicating to a user the current operating stage of the cooking appliance.

2. Description of the Related Art

Over the years, there have been many advances in the art of cooking appliances. Various heat sources, such as convection air, microwave and IR heating elements have been used, in one way or another, to perform cooking operations. Mechanical components such as switches, thermostats and other controls have been replaced, or at least supplemented, by electronic control systems. Rotary knobs are slowly giving way to touch pads and touch screen displays. Many new features have been added to the cooking appliance, such as pre-programmed operations, recipes, and multi-stage cooking operations. Many ovens, ranges and the like available on the market today incorporate, to certain degrees, programmable features intended to aid a consumer in performing cooking operations. Some electronic control systems for cooking appliances enable a consumer to input certain cooking information, such as cooking modes, times and temperatures, with the inputted information generally being presented in a viewable display area and used to establish a cooking operation.

As set forth above, there have been various developments in the art of cooking appliances directed to aiding a consumer in performing certain cooking operations effectively. However, there still exists a need for a more user friendly system for conveying information regarding a current operating stage to a user. More specifically, there exists a need for an electronic control system which functions to display to a user the current stage in a clear manner such that the user can be informed of the current stage of the cooking appliance, even from a distance.

SUMMARY OF THE INVENTION

The present invention is directed to a cooking appliance including a cabinet defining an oven cavity, a door attached to the cabinet for selectively exposing and sealing the oven cavity, a cooking element mounted to the cabinet for heating the oven cavity, a control system for controlling the cooking appliance and a display. The display is adapted to show a first series of images corresponding to a first operating stage and a second series of images corresponding to a second operating stage, wherein the first series of images is distinct from the second series of images such that a user may readily identify a current operating stage of the cooking appliance, even from a distance, based on the series of images being displayed. The first series of images and second series of images are displayed repeatedly during a preheat stage and a cooking stage of the cooking appliance, respectively. Additional series of images may be displayed during additional cooking stages such that the user may identify the current cooking stage based on the series of images.

Additional objects, features and advantages of the present invention will become more readily apparent from the following detailed description of preferred embodiments of the invention when taken in conjunction with the drawings wherein like reference numerals refer to corresponding parts in the several views.

DETAILED DESCRIPTION OF THE PREFERRED EMBODIMENTS

Figure 1:
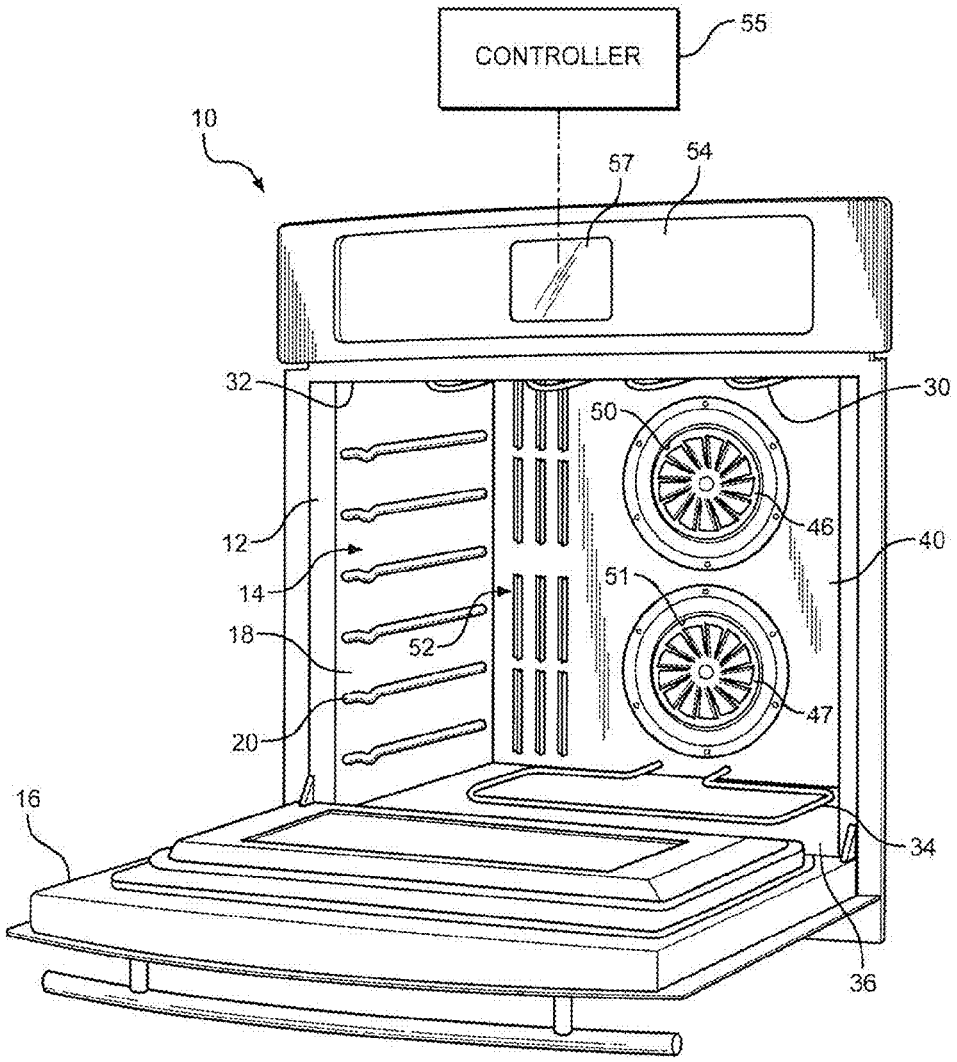
FIG. 1 is a perspective view of a cooking appliance incorporating a display constructed in accordance with the present invention.

With initial reference to FIG. 1, a combination radiant heat and convection oven is generally indicated at 10. In the preferred embodiment shown, oven 10 is a wall-mounted or built-in oven, and includes a cabinet 12 which forms an oven cavity 14. A door 16 is pivotally mounted to cabinet 12 for selectively closing oven 10 and sealing oven cavity 14. Oven cavity 14 includes opposing side walls 18 having a plurality of spaced rails 20 for supporting repositionable racks (not shown) in a manner known in the art.

Oven 10 also includes a plurality of heating elements. More specifically, oven 10 includes an upper broil element 30 mounted adjacent an upper wall 32 of oven cavity 14 and a lower bake element 34 mounted adjacent a lower wall 36 of oven cavity 14. Upper broil element is constituted by a 3600 watt resistive-type electric heating element, while lower bake element 34 is constituted by a 2800 watt resistive-type electric heating element. A convection cover 40 is adapted to be mounted over first and second motor driven fans 46 and 47 within oven cavity 14 as will be discussed more fully below. Fans 46 and 47 are constituted by multi-speed electric fans which can be continuously operated or pulsed. Fans 46 and 47 are centrally mounted and vertically arranged within oven cavity 14, such that first and second fans 46 and 47 are aligned with and positioned at respective first and second circular apertures 50 and 51 formed in convection cover 40. Convection cover 40 also includes a plurality of spaced angled louvered openings 52 on either side of first and second fans 46 and 47, with louvered openings 52 being adapted to distribute heated air evenly throughout oven cavity 14. The details of oven 10 are for illustrative purposes only. In general, the present invention is directed to a user interface 54 and display 57 arranged in communication with a controller 55, and is not meant to be limited for use with any particular oven.

As illustrated in FIG. 1, oven 10 is equipped with a display 57 through which information may be conveyed to a user. In accordance with the present invention, display 57 is adapted to depict various animations to convey information related to the current operating stage of oven 10. For example, one animation is displayed to indicate that oven 10 is in a preheat or first operating stage and another animation is displayed to indicate when oven 10 is in a cooking or second operating stage.

According to one embodiment of the invention, as illustrated in FIGS. 2A-2D, display 57 shows a series of images, in sequence, to indicate a preheat stage. FIGS. 2A-2D illustrate four images from one possible series of images, which are made up of a plurality of lines that become progressively more intense with each image. The images of FIGS. 2A-2D may be presented in a color representative of heat, such as red or orange. Thus, the color of the lines shown may also become brighter with each image. In addition, the intensity or brightness of the images may vary as the preheat stage progresses to show that the oven temperature is nearing a desired cooking stage. The series of images may include any number of images such that, when the series of images is displayed at a high speed, an animation is provided. The series of images is preferably includes images of increasing intensity that are shown successively for the duration of the preheat cycle. For example, the series of images may include five thousand images, four of which are illustrated by FIGS. 2A-2D. The series of images may be displayed such that about twenty different images or frames are shown each second. In another embodiment, a series of images may be looped during the preheat cycle. Thus, a smaller number of images would be included in a series, but the series would loop or repeat continuously for the duration of the preheat cycle. The high speed repletion or looping of the series of images gives the illusion of a continuous animation. In addition, the looping of the series of animations may quicken as the oven reaches the end of the preheat cycle. Therefore, a user may view display 57 from a distance and recognize the progression of the preheat cycle based on the pace of the looping of the series of animations. However, it should be understood that the speed, number and content of the images may be varied and still be within the scope of the invention.

Following the completion of the preheat stage, oven controller 55 senses when the internal temperature of the oven 10 has reached a desired cooking temperature. Thereafter, controller 55 causes display 57 to show a second animation that corresponds to a second stage, i.e., the cooking stage. It should be understood that separate animations may exist for various cooking operations, such as a Bake, Broil or Convection. For the sake of simplicity, FIGS. 3A-3D will be described with reference to a general cooking stage. As illustrated in FIGS. 3A-3D, display 57 shows a series of images, in sequence, to indicate an active cooking stage. FIGS. 3A-3D illustrate four images from one possible series of images, which represent flames that vary or become progressively more intense with each image. Like FIGS. 2A-2D, the images of FIGS. 3A-3D may be presented in a color representative of heat, such as red or orange. Thus, the color of the lines shown may become brighter with each image. The series of images may include any number of images such that when the series of images is displayed at a high speed it is presented as an animation. The series of animations may be repeated or looped at high speeds for the duration of the preheat cycle. For example, corresponding to that disclosed above for the preheat stage, the series of images may include twenty images, four of which are illustrated by FIGS. 3A-3D. The series of twenty images may be displayed successively every second, such that twenty images or frames are shown each second. The high speed looping of the series of images gives the illusion of a continuous animation. However, it should be understood that the speed, number and content of the images may be varied and still be within the scope of the invention.

Figure 2A:
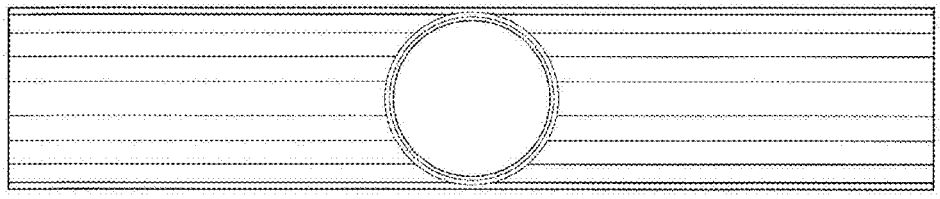
FIGS. 2A-2D illustrate a series of images corresponding to a first operating stage in accordance with an embodiment of the invention.
Figure 2B:
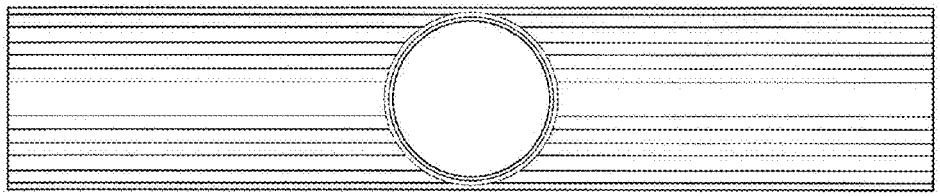
Figure 2C:
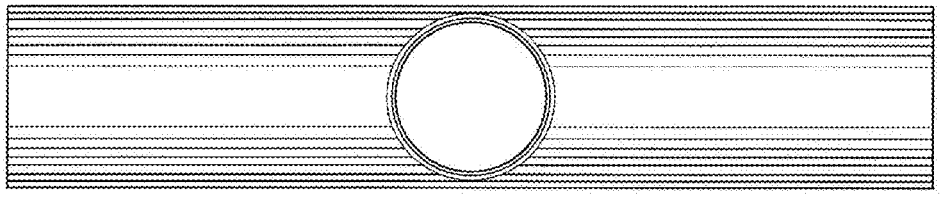
Figure 2D:
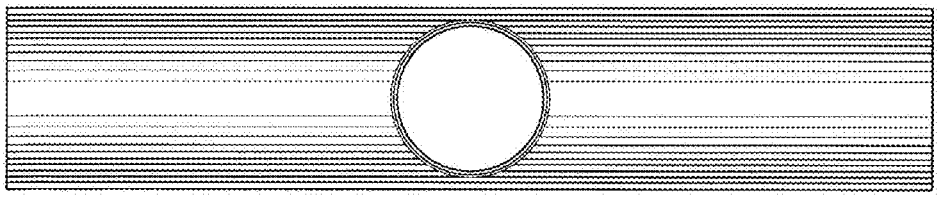
Figure 3A:
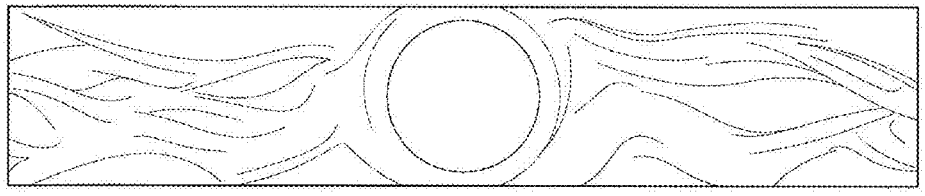
FIGS. 3A-3D illustrate an additional series of images corresponding to a first operating stage in accordance with an embodiment of the invention.
Figure 3B:
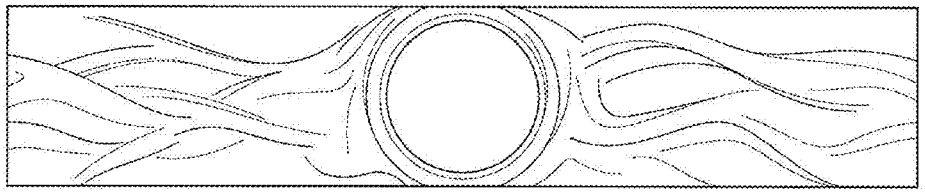
Figure 3C:
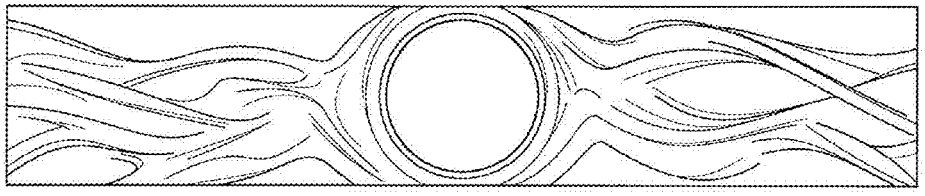
Figure 3D:
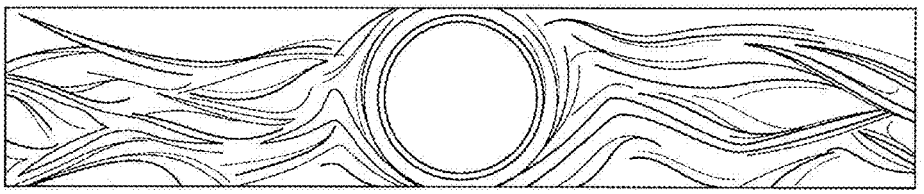

At this point, an additional exemplary cooking sequence will be described. As set forth above, a series of images is shown to make up an animation for each operating stage to indicate the current stage to a user. Initially, oven display 57 may show an idle screen (not shown), such as a clock to indicate that oven 10 is not in use. The user may program oven 10 to perform a multi-stage cooking operation, such as a preheat stage, a cooking stage (perhaps multiple, sequential cooking stages), and a warming stage to keep the food warm for a specified amount of time until serving. Upon starting the cooking operation, oven 10 initiates a preheat stage. During the preheat stage, display 57 displays a series of images, as shown in FIGS. 2A-2B, in sequence. The series of images is looped at a high speed for the duration of the preheat stage. A user may view display 57 from a distance and recognize that the images being displayed represent the preheat stage.

When the preheat stage is complete, controller 55 automatically causes oven 10 to begin a cooking stage, such as a baking stage. Thus, display 57 begins to display a second series of images, as shown in FIGS. 3A-3D. The series of images, which represent flames in the embodiment shown, are looped continuously for the duration of the baking stage. As with the preheat stage, a user may view display 57 from a distance and recognize that the images being displayed represent the baking stage. Following the baking stage, the oven may being a warming stage to keep the food warm until serving. A separate series of images (not shown) may be displayed to indicate the warming stage. As discussed with respect to the preheating and baking stages, the series of images is repeated continuously for the duration of the warming stage.

Although described with reference to preferred embodiments of the invention, it should be readily understood that various changes and/or modifications can be made to the invention without departing from the spirit thereof. For instance, although a combination radiant and convection system has been described, other cooking systems, such as a microwave system, could also be integrated into oven 10. In addition, any number of different animations may be used to indicate a cooking stage. The animation may be simple, based on a few images, or may be very complex, based on a large number of images. The images may represent flames, oven coils or may even be user selected images to indicate the current stage of the oven. Therefore, the invention is only intended to be limited by the scope of the following claims.

I claim:

1. A method of monitoring a cooking appliance having a oven cavity, at least one heating element, a controller and a display for cooking food during a cooking operation having multiple operating stages, said method comprising:

initiating a first operating stage of said cooking appliance, wherein said first operating stage of the cooking appliance is a preheat stage;

presenting on said display a first series of images indicating operation of the cooking appliance in the first operating stage;

initiating a second operating stage of said cooking appliance;

presenting on said display a second series of images indicating operation of the cooking appliance in the second operating stage, wherein said first series of images is distinct from said second series of images such that a user can distinguish between the first and second operating stages of the cooking appliance, even from a distance, based on a particular series of images being displayed, with each of the first and second series of images being displayed as an animation throughout a respective one of the first and second operating stages; and repeatedly displaying said first series of images during said preheat stage of the cooking appliance, wherein said first series of images is repeatedly displayed progressively faster as the preheat stage progresses.

2. The method of claim 1, further comprising: presenting said first series of images as a series of images of multiple lines, with each image having a progressively higher intensity of lines to portray the preheating of the oven cavity.

3. The method of claim 1, wherein said second operating stage of the cooking appliance is a cooking stage.

4. The method of claim 3, further comprising: presenting said second series of images as a series of images of flames, wherein the series of images appears as flickering flames when shown in sequence.

5. The method of claim 3, further comprising: repeatedly displaying said second series of images during said cooking stage of the cooking appliance.

6. The method of claim 1, further comprising: presenting on said display a third series of images for indicating a third operating stage of the cooking appliance.

7. The method of claim 6, wherein said third stage is a warming stage.

8. The method of claim 7, further comprising: repeatedly displaying said third series of images during said warming stage of the cooking appliance.

9. The method of claim 1, wherein each of the first and second series of images are displayed as a continuous animation.

10. A cooking appliance comprising:

a cabinet defining an oven cavity;

a door attached to the cabinet for selectively exposing and sealing the oven cavity;

a heating element supported by the cabinet for heating the oven cavity;

a control system establishing a cooking operation having multiple operating stages for the cooking appliance; and a display presenting a first series of images corresponding to a first operating stage and a second series of images corresponding to a second operating stage, wherein said first operating stage of the cooking appliance is a preheat stage wherein said first series of images is distinct from said second series of images such that a user can distinguish between the first and second operating stages of the cooking appliance, even from a distance, based on a particular series of images being displayed, wherein each of the first and second series of images is displayed as an animation throughout a respective one of the first and second operating stages, wherein said first series of images is displayed repeatedly during said preheat stage of the cooking appliance, and wherein said first series of images is repeatedly displayed progressively faster as the preheat stage progresses.

11. The cooking appliance according to claim 10, wherein said first series of images is a series of images of multiple lines, with each image having progressively higher intensity to portray the preheating of the oven cavity.

12. The cooking appliance according to claim 10, wherein said second operating stage of the cooking appliance is a cooking stage.

13. The cooking appliance according to claim 12, wherein said second series of images is a series of images of flames, wherein the series of images appears as flickering flames when shown in sequence.

14. The cooking appliance according to claim 12, wherein said second series of images is displayed repeatedly during said cooking stage of the cooking appliance.

15. The cooking appliance according to claim 10, wherein said display further displays a third series of images for indicating a third operating stage of the cooking appliance.

16. The cooking appliance according to claim 15, wherein said third operating stage is a warming stage.

17. The cooking appliance according to claim 16, wherein said third series of images is displayed repeatedly during said warming stage of the cooking appliance.

18. The cooking appliance according to claim 10, wherein each of the first and second series of images are displayed as a continuous animation.

* * * * *